United States Patent [19]

Kuehnle

[11] 4,419,005

[45] Dec. 6, 1983

[54] IMAGING METHOD AND APPARATUS

[75] Inventor: Manfred R. Kuehnle, New London, N.H.

[73] Assignee: Coulter Systems Corporation, Bedford, Mass.

[21] Appl. No.: 317,448

[22] Filed: Nov. 2, 1981

[51] Int. Cl.[3] ..... G03G 15/00

[52] U.S. Cl. ..... 355/3 TR; 355/3 P; 355/14 TR; 118/56; 118/641; 430/126; 430/130; 430/136

[58] Field of Search ..... 355/14 TR, 3 P, 3 TR; 118/640, 641, 56; 430/126, 130, 136

[56] References Cited

U.S. PATENT DOCUMENTS

| | | | |
|---|---|---|---|
| 3,741,760 | 6/1973 | Snelling | 355/3 P X |
| 3,893,761 | 7/1975 | Buchan et al. | 118/641 X |
| 4,055,418 | 10/1977 | Buckley et al. | 430/126 X |
| 4,073,583 | 2/1978 | Teumer et al. | 355/3 P |
| 4,320,186 | 3/1982 | Kato et al. | 430/126 X |

*Primary Examiner*—A. C. Prescott

*Attorney, Agent, or Firm*—Silverman, Cass & Singer, Ltd.

[57] ABSTRACT

An electrostatic method of making transparencies and apparatus for practicing said method. An endless electrophotographic belt is charged, imaged and toned with a liquid toner suspension. The belt with the toned image is brought into close proximity to a precisely dimensioned gap defined by a transfer roller along with a sheet of transfer material comprising a transparent substrate polyester carrying a thin ohmic layer bonded thereto and a thin overcoat of a compatible resinous material on the ohmic layer and bonded thereto. An electrical bias is applied across the gap between the belt and the overcoated ohmic layer. The toner particles migrate electrophoretically toward the transfer sheet. Subsequent to transfer, heat is applied to the transfer sheet sufficient to soften the overcoating embedding the transferred toner particles of the toner image within the resin. The transfer material is cooled. The resulting transparency comprises the coated transparent member having the toner image embedded in the resin coating below the surface thereof.

5 Claims, 2 Drawing Figures

IMAGING METHOD AND APPARATUS

BACKGROUND OF THE INVENTION

This invention relates generally to image carrying transparencies and a method for making same and more particularly, concerns the provision of transparencies formed electrophotographically and comprising a transparent plastic sheet substrate, a thin ohmic layer bonded thereto and a thin overcoat layer of a compatible resinous material itself carrying a toner image embedded within said resinous material. The transfer is effected electrophoretically without residual material remaining on the electrophotographic recording member, the overcoating being softened subsequent to receipt of the toned image to effect said embeddment.

In U.S. Pat. No. 4,025,339 an electrophotographic member has been described which includes a photoconductive coating formed of a crystalline deposit of a wholly inorganic material on a suitable substrate, such as a thin clear flexible plastic sheet with an intervening thin ohmic layer such as tin-indium oxide, in a sputtering method that results in unusual properties. The photoconductive coating has the ability to function as means for storing and selectively discharging an electrical charge. When exposed to light the radiation pattern forms a latent electrostatic image in the photoconductor surface which is toned to render same visible.

It is known to transfer the toned electrostatic images to a receiving member which may comprise a thin transparent plastic sheeting. Transfer can be effected employing dry transfer methods conventionally described as cascade toning or development employing dry electroscopic toner particles. Alternatively, development of the electrostatic latent image can be effected using liquid toning techniques wherein toner particles are dispersed in suspension in an insulating hydrocarbon liquid. Liquid toner techniques offer improved resolution due to the small size of the dispersed particles. Accordingly, in order to take advantage of the unusual properties of the patented electrophotographic recording member, liquid toning methods conventionally are used.

Transfer of toned images directly to sheet plastic receiving members has been successful. Bias voltages have been employed during the transfer with success. Notwithstanding the production of transparency sheets using those known methods, adherence of the toner images on the substrate surface has been less than desirable. The advent of fusible toner particles alleviated the adhesion problem to some degree but the result was a surface which was not sufficiently smooth for use of the resultant transparency, say for optical projection. Further, the high resolution obtained using the patented electrophotographic recording member, as well as the optical density of the resultant image, was not always fully retained upon transfer. Lateral displacement was a problem.

Incomplete transfer often resulted, leaving a residue toner on the recording member, necessitating additional steps of carefully cleaning the electrophotographic surface of such residual deposit before reuse. The recording member itself could be used as a transparency providing the substrate was transparent but the photoconductive coating usually carried thereby has a characteristic tint to the substrate, yellow in color where CdS is used as the coating material. Such transparencies as result by fusing a toned transferred image onto the electrophotographic member are unsatisfactory because of such tint and because they are expensive in view of the cost of the recording medium.

Adhesive substances have been applied as a coating to sheet material but do not result in transfer without loss in resolution and optical density at selected areas. The transfers obtained are not satisfactory because the adhesive tends to result in so-called blocking, that is, bonding of the sheets together when placed thereupon even when cool. The blocking effect required the lamination of an additional thin foil of plastic over the image to protect it against blocking, dust collection and scratching. Unfortunately, the thin overlay foil eliminates the making of contact duplicate films, a vital necessity in the film business, as it prevents direct image contact because the foil acts as a spacer. The resulting resolution loss introduced by light scatter in the space located by the foil becomes unacceptable.

SUMMARY OF THE INVENTION

Method and apparatus for making high resolution transparencies electrostatically comprising electrophotographic imaging apparatus including an electrophotographic medium having an outer coating of a microcrystalline wholly inorganic photoconductive material bonded to a substrate and capable of being charged and of holding a charge on the surface thereof in a magnitude sufficient to be imaged and toned, an exposure station of exposing the charged surface to a radiation pattern of an image to be reproduced to form an electrostatic latent charge image thereon, a toning station for development of said latent image with liquid toner, a transfer station, means for feeding transfer sheet material to said transfer station simultaneously with arrival of the toned image on the electrophotographic medium at said transfer station, said transfer sheet material carrying an ohmic layer and a compatible resinuous overcoat bonded thereto. The transfer station includes a pair of roller members arranged to define a gap therebetween, and means are provided; to cause electrophoretic migration of the toner image toward the ohmic layer to the overcoating on the transfer material. The transfer sheet is heated immediately after leaving the electrophotographic medium for softening the overocat and embedding the toner image therein. Cooling is effected. After cooling, the transfer medium retains the toner image fully embedded within said now solid resin coating with full retention of the optical density and resolution of the toner image as formed on said electrophotographic medium.

The invention provides means for locally heating the transfer sheet downstream of said gap to soften the resin coating so it becomes soft causing the insulating liquid of the toner to evaporate and means for applying an electrical bias voltage across said gap.

DESCRIPTION OF PREFERRED EMBODIMENTS

Figure 1:
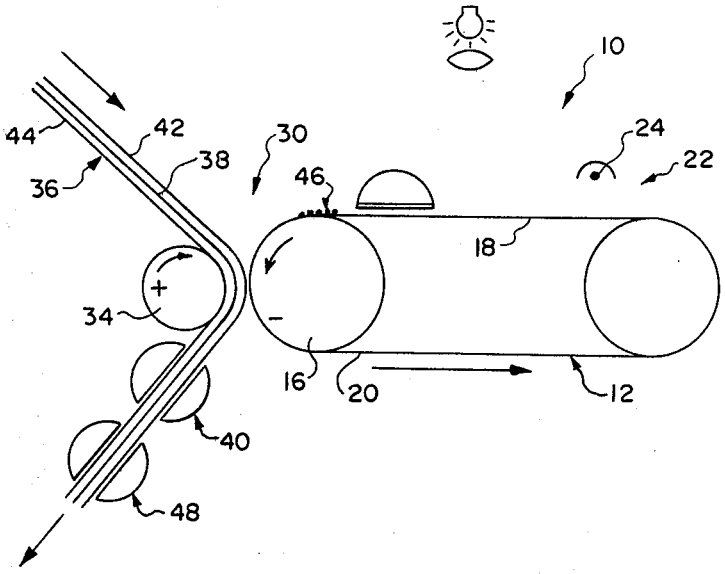
FIG. 1 is a diagrammatic view of the transparency making electrophotographic apparatus according to the invention.
Figure 2:
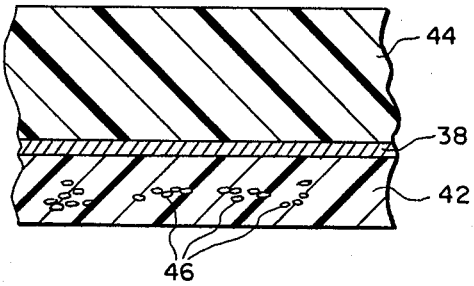
FIG. 2 is a cross-sectional transverse view of the transparency resulting from use of the apparatus of FIG. 1.

The invention, briefly, provides an electrophotographic apparatus for making transparencies, including an electrophotographic belt mounted on a pair of rollers to define a pair of opposite parallel reaches. The belt has a photoconductive coating on its outer surface which is capable of being charged and holding the charge sufficiently to be toned electrophoretically using liquid toner.

A transfer station is located immediately downstream of the toner or developing station.

The transfer station includes a roller about which is passed a transfer medium comprising a flexible substrate strip or sheet preferably formed of polyester plastic material. The transfer sheet also is provided with a thin layer of ohmic material and an overcoat of a resinous material compatible with the substrate.

A gap is defined between the transfer sheet and the image carrying belt surface. A bias voltage is applied to the transfer roller to enable electrically assisted migration of the toner particles from the surface of the belt to the coated surface. Localized heating downstream of the gap is provided whereby the resin is softened to embed the toner particles in the resin overcoat. The heating also can function also to evaporate any insulating liquid remaining associated with the toner particles. After softening, the transfer sheet is cooled and the toner particles remain in cooled, now hardened resin. Complete transfer of the toned image is effected with the toner particles thereof embedded permanently within the coating. The transfer is effected electrophoretically with one roller functioning as a development electrode. Full transfer without loss of resolution or reduction of optical density is achieved.

The strip of transfer medium is formed by coating a substrate using conventional coating methods. A sheet of polyester substrate material is formed of a polyethylene terpthalate polymer sold under the trademark MYLAR by DuPont Company of Wilmington, Del. The substrate is 5 mils in thickness and is heat treated by the manufacturer to increase its dimensional stability.

A thin layer of ohmic material such as indium oxide, zinc indium oxide or like semi-conductor material, is applied to the substrate material preferably by sputtering processes such as discussed in U.S. Pat. No. 4,025,339.

The overcoating resinuous material preferably of a polyester resin normally adherent to the ohmic layer of the substrate material, which is nonblocking, that is, will not (after application) either bond to itself or to the substrate. The coating material selected must be chemically resistant as well as abrasion resistant. The resin selected must soften at a temperature that does not affect the plastic substrate or lessen the adherence of the ohmic layer to the substrate. Additionally, the resin must allow easy mobility of the toner particles after the transfer process and it must exhibit a high electrical surface resistivity such as $10^{15}$ ohm to prevent discharge of the toner particles.

Referring to the drawing, FIG. 1 illustrates the electrophotographic system of the invention designated generally by reference 10. System 10 comprises an electrophotographic belt 12 mounted for rotation on a pair of rollers 14,16. The mounted belt 12 defines a pair of parallel reaches 18,20.

The functional stations are positioned along the reaches 18,20 with the charging station 22 located at the commencement of reach 18. The charging station 22 includes a corona generating device 24 for applying a charge potential on the photoconductive coating on the outer surface of the electrophotographic belt.

The belt 12 is rotated to position the charged section thereof in position to receive a projected actinic radiation pattern of the image to be reproduced forming a latent electrostatic charge image of the pattern projected thereon.

The belt then is again rotated to draw the image carrying portion to and through a development station 28 located downstream of the projected image, where the latent image is rendered visible electrophoretically by application thereto of a suspension of toner particles 46 in an insulating liquid medium.

The toned image is then brought while still in darkness to the transfer station 30, preferably in a wet or at least moist state.

Transfer is caused by the electrical bias, the image being propelled to the resin coating by the attraction toward the ohmic layer, the latter being subjected to a substantial external voltage applied between ohmic layer and photoconductor. Heating to soften the overcoat resin is subsequent to transfer.

The dispersant insulating liquid clinging to the toner particles after transfer is evaporated as by heating or perhaps, drawing air thereover, during or just prior to softening of the resin overcoat subsequent to transfer.

The transfer station preferably is located spaced from the development station adjacent the driven mounting roller for the electrophotographic belt to enable drying of the toned image in transit. The transfer station 30 includes a roller 34 arranged to be driven in a direction opposite to that of roller 16. The axes of rollers 34 and 16 are disposed to define a precisely spaced gap between the strip 36 of transfer medium and the belt surface. A bias voltage of 50 to 100 V is generated between the ohmic layer 38 of the strip of transfer medium and the ohmic layer of the electrophotographic belt 12.

The heat is applied to the strip 36 of transfer medium at 40 sufficiently to soften the resin coating 42 from the gap without melting or softening the substrate 44 or affecting the adherence of the ohmic layer. The resin overcoat becomes sufficiently tacky to hold the toner particles in place to travel through the softened resin. Because of the bias, the transfer is direct without lateral displacement or loss. When cooled, say at 48, the toner particles 46 are firmly embedded in to the overcoat. No residue remains on the electrophotographic belt.

The transfer medium is cooled by cooled station 48 once past the heater 40 so that the softened resin layer is hardened quickly, leaving the toned image embedded on the coating or perhaps even within the solidified resin coating. The high resolution obtained during the electrophotographic process of imaging and toning is retained after transfer.

The high gloss, smooth abrasive, resistant transparency results, without loss in optical density, as transfer is complete. The belt can be immediately reused after transfer for a new series of imaging, etc.

I claim:

1. A method of transferring an electrophotographically formed toner image comprising the steps of: electrophotographically forming a toner image on the photoconductive coating surface of a flexible electrophotographic film member by successively charging the photoconductive surface, exposing the charged surface to actinic radiation representing an image pattern forming a latent electrostatic charge image of said pattern on said photoconductive coating surface and toning the latent electrostatic charge image with liquid toner comprising discrete toner particles suspended in an electrically insulating liquid, providing a transparent transfer sheet material consisting of a substrate having a thin ohmic layer and a thin coating of a resinuous composition bonded to said ohmic layer, said resinous coating having a softening range lower than the softening range of the substrate, transporting the wet toner image carrying electrophotographic member and the transfer sheet material simultaneously to and through a precise gap defined therebetween with the resin coating facing and in proximity to the toner image carrying photoconductive surface and while the toner image is wet, applying an electrical bias voltage across said gap during passage of said electrophotographic member and said transfer sheet material therethrough electrophoretically to transfer said toner image to the facing surface of said resin coating of the transfer sheet, drying the transferred toner image by removing any residual insulating liquid therefrom, locally heating transfer sheet sufficient to soften the resin coating whereby to embed the discrete toner particles defining the transferred toner image within said coating, the transfer of the toner image being effected without loss in resolution or optical density.

2. The process as claimed in claim 1 and the step of cooling the transfer sheet subsequent to embedment of the toner image therein.

3. The process as claimed in claim 1 in which no residue is left on the photoconductive surface of the electrophotographic member subsequent to completion of the transfer step.

4. Apparatus for practicing the method of claim 1 comprising an electrophotographic member, means for charging, exposing and toning said electrophotographic member with liquid toner to produce a toner image thereon, a transfer station including a transfer roller spaced from said electrophotographic member and defining therewith a predetermined transfer gap, means for developing a bias voltage across said gap, means for delivering a resin overcoated transfer sheet member to said gap simultaneously with arrival thereat of the toner image carrying portion of said electrophotographic member electrophoretically to transfer the toner image to the resin overcoated transfer member, means for drying the transferred toner image on the resin overcoated surface, means for heating said resin overcoated transfer sheet member subsequent to emergence from said gap to soften the resin overcoat sufficient to embed the toner image below the surface of the softened overcoat.

5. Apparatus as claimed in claim 4 and means for cooling said transfer sheet subsequent to embedment of the toner image therein.

* * * * *